United States Patent [19]

Vitelle

[11] Patent Number: 4,778,082

[45] Date of Patent: Oct. 18, 1988

[54] COLLAPSIBLE TUBE SQUEEZING DEVICE

[75] Inventor: Roy S. Vitelle, Pomona, Calif.

[73] Assignee: Vernon K. Vitelle, Upland, Calif. ; a part interest

[21] Appl. No.: 730,280

[22] Filed: May 3, 1985

[51] Int. Cl.[4] ..... B65D 35/28

[52] U.S. Cl. ..... 222/95; 24/198

[58] Field of Search ..... 222/92, 95, 103, 104, 222/206, 99; 24/198, 200, 186, 543, 30.5 R; 206/277; 383/69, 65

[56] References Cited

U.S. PATENT DOCUMENTS

| | | | |
|---|---|---|---|
| 2,083,603 | 6/1937 | Harwick | 222/95 |
| 2,285,714 | 6/1942 | Hirsh | 24/198 |
| 3,248,012 | 4/1966 | Adams | 222/95 |
| 3,279,019 | 10/1966 | Eubank et al. | 24/200 |
| 4,020,976 | 5/1977 | Mineo | 222/103 |
| 4,270,672 | 6/1981 | Kraals | 222/95 |
| 4,520,533 | 6/1985 | Kasai | 24/198 |
| 4,574,983 | 3/1986 | Fatkin | 222/95 |

FOREIGN PATENT DOCUMENTS

| | | | |
|---|---|---|---|
| 1482872 | 6/1967 | France | 222/95 |

*Primary Examiner*—Joseph J. Rolla
*Assistant Examiner*—Kenneth Noland
*Attorney, Agent, or Firm*—Henry M. Bissell

[57] ABSTRACT

A device for use with flexible, collapsible plastic tubes containing a pliable substance for extrusion through an opening in the tube is disclosed which effectively strips the substance in the tube toward the end of the tube having the opening. The device includes a handle and has a slot disposed near an edge thereof through which the flat end of the tube is inserted. The device, which may be molded of plastic, is of one-piece construction, is small and inexpensive, and may have a variety of surface configurations.

19 Claims, 1 Drawing Sheet

COLLAPSIBLE TUBE SQUEEZING DEVICE

BACKGROUND OF THE INVENTION

1. Field of the Invention

The present invention relates generally to devices for efficiently stripping pliable substances from a flexible, collapsible tube and, more particularly, to a simple and inexpensive device for completely removing such substances from a plastic tube having an opening from which the substance contained in the tube is extruded, such as, for example, a toothpaste tube.

2. Description of the Prior Art

One of the most efficient containers for pliable substances having a paste-like texture is a flexible tube which is collapsed as the substance contained in the tube is removed by exertion of pressure on the tube, typically by manually squeezing the tube to expel the substance, which is generally extruded through an opening substantially smaller than the diameter of the tube. Such tubes have been used for storage, transport, and sale of such diverse substances as toothpaste, hair cream, skin conditioners, greases, oil paints, and adhesives, to mention a few.

Until a number of years ago, the construction material of such collapsible tubes comprised flexible metal foils such as lead or aluminum. Metal tubes have a number of disadvantages, such as sharp edges when the tubes were bent and their propensity to tear, in addition to the unsuitability of lead for tubes containing substances for oral consumption such as toothpaste due to the toxicity of lead. The desire to allay these disadvantages led to the substitution of other materials for tube fabrication.

Within the last 20 years or so plastic tubes have largely supplanted metal foil tubes due to the factors mentioned above as well as an even more important factor, namely that of cost. Plastic tubes are easier and cheaper to construct than metal foil tubes, and present none of the disadvantages of metal foil tubes mentioned above. Plastic tubes also present neater packaging for products and are more desirable to consumers for anything from toothpaste to grease.

The frugal nature of many consumers has led to demand for devices for squeezing out the last bit of substance contained in the tube, with such devices ranging from the simple (and cheap) to the relatively complex (and more costly). Such devices may be categorized in one of two categories, namely the tube key and the dispenser.

The tube key has been the most popular device due to both its efficient operation with metal tubes and its low cost. The tube key is typically made of plastic and resembles a key with a slotted cylinder instead of the key element. The end of a tube is inserted into the slot, and the tube key is turned to wind the collapsible tube around the cylinder, squeezing the substance contained in the metal foil tube toward the end of the tube containing the opening.

The tube key works extremely well with a metal foil tube, and has been very favorably received by the public as a result. However, the tube key is much less effective with a plastic tube. Such plastic is a resilient material, the collapsed portion of a plastic tube will not wrap easily around the tube key or stay wrapped once it is around the tube key.

The practical effect of this is that the plastic tube must be rewound with each use, since after it is released it will return to its original shape. The use of the tube key with a plastic tube requires more work than it is worth and, since plastic tubes have largely replaced metal foil tubes, tube keys are no longer widely used, since they are simply not practical for use with a plastic tube.

The other type of device used to remove a substance from a tube is the dispenser, which works better with plastic tubes than does the tube key. Dispensers designed for use with disposable tubes generally hold the tube and apply pressure to the tube to cause the substance contained therein to be forced out, with some dispensers also containing valving mechanisms to meter the substance as it is extruded from the tube.

Dispensers use a number of different techniques to apply pressure to the tube, including rollers, ratchets, plungers, levers, wedges, and compressing surfaces, all with the object of economically removing all of the substance contained in the tube, with varying degrees of success. Although such devices work with plastic tubes, they have several problems making them something less than perfect solutions. One such problem is the amount of work needed is not appreciably lessened, since the tube must be installed and the device must be operated, an often complicated and time-consuming process.

Another problem is that the dispensing devices are usually eyesores, often requiring permanent installation, an unpopular requirement particularly in the bathroom when used to dispense toothpaste. Even if the device can be put away, it is generally substantially bulkier than the tube alone. Such devices also often dispense considerably more of the substance in the tube than is needed, making the devices wasteful rather than saving as intended. Finally, dispensing devices are not cheap, making the user spend a lot to save a little. Needless to say, dispensing devices are largely seen as gadgets rather than as genuine solutions to the need.

It is therefore apparent that there exists a need for an inexpensive but effective device to extrude the contents from a collapsible plastic tube. Such a device should be simple both in design and in use, making it both easily affordable and desirable to have. It should be small in size, such as the tube key for use with metal foil tubes. Finally, the device should present these advantages in a package which is commercially marketable, making it susceptible not only to mass production but also to mass sale as a desirable, affordable, and easily usable product appealing to virtually everyone.

SUMMARY OF THE INVENTION

The present invention has all the advantages of the tube key used with metal foil tubes, and in addition is easily and effectively usable with plastic tubes. It is of unitary plastic construction, and consists of a surface having a handle portion and a slot passing therethrough near one edge of the device. The slot is long enough to accept the flattened body of the tube the device is to be used with, and wide enough to accept the end of the tube away from the opening of the tube into the slot.

By sliding the device along the tube, the end of the tube away from the opening is flattened and the substance contained in the tube is moved toward the end of the tube having the opening. In some cases, it may be desirable to orient the device at an angle other than perpendicular to the flattened portion of the tube as the device is slid along the surface of the tube to ensure that the walls of the tube are squeezed together tightly to force all of the substance toward the opening in the tube. Accordingly, the configuration of the slot in the preferred embodiment has rounded edges rather than straight 90° edges to facilitate movement of the device along the tube at an angle other than perpendicular.

The device may be manufactured to fit different sizes of tubes. However, it is anticipated that the largest market for the device is for a size fitting standard size tubes of toothpaste. Obviously, there are many possible configurations for the device, with several being specifically disclosed herein, including triangular, semi-circular, and rectangular configurations.

The present invention is inexpensive to manufacture, and is preferably molded from a rigid type of plastic, in a variety of colors or in a marbled texture. Due to its inexpensive nature, it may even be used as a promotional item for give-away advertising campaigns, and is thin enough to be mailed in an envelope. The present invention presents none of the disadvantages of either tube keys or dispensers, while solving all of the problems associated with these devices and mentioned above. Finally, in addition to these advantages and its inexpensive nature, the present invention is a device which works extremely well in accomplishing its task, and is quite simple to use, making it a desirable solution to the problem addressed.

DESCRIPTION OF THE DRAWING

A better understanding of the present invention may be had from a consideration of the following detailed description, taken in conjunction with the accompanying drawings in which.

DESCRIPTION OF THE PREFERRED EMBODIMENT

Figure 1:
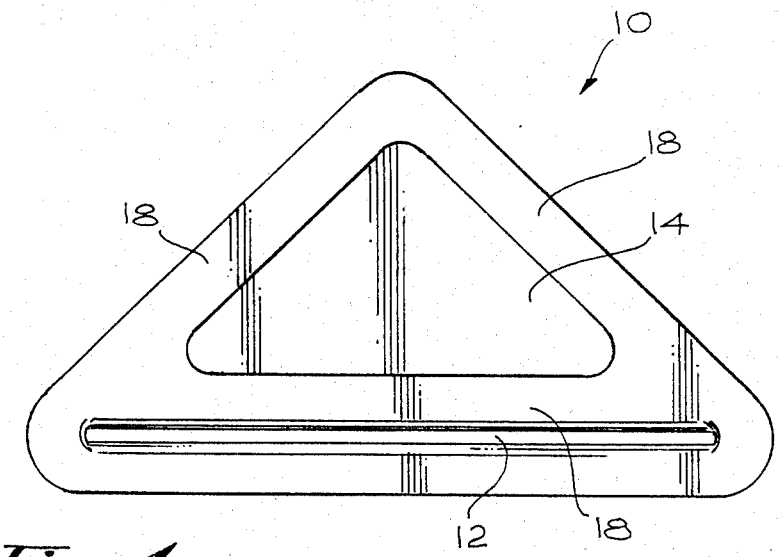
FIG. 1 is a plan view of the triangular configuration preferred embodiment of the present invention.
Figure 2:
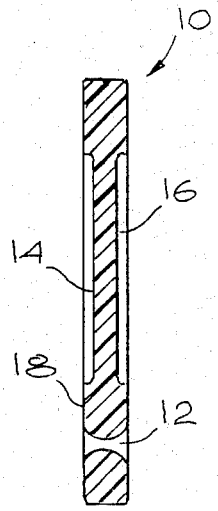
FIG. 2 is a cross-sectional view of the preferred embodiment of the present invention shown in FIG. 1.

The preferred embodiment of the present invention, which is illustrated in FIGS. 1 and 2, is a tube squeezing device 10 of generally triangular configuration. The device 10 is preferably in the form of a generally planar member made of relatively rigid plastic material such as high impact polystyrene in an injection molding process, the details of which are well known in the art. The molding process can be carried out in automatic injection molding equipment, so it may be appreciated that the manufacturing process is quite inexpensive. In addition, the device 10 may be molded in any color desired, including even a marbled color composition.

The device 10 may be seen essentially as a flat surface having a handle portion and a slot 12 near one edge of the device 10 and away from the handle portion. In the preferred embodiment triangular insets 14, 16 are molded into the device 10, with the triangular inset 14 being located on one side of the device 10, and the triangular inset 16 being located on the other side of the device 10 opposite the triangular inset 14. The triangular insets 14, 16 are located away from the edge of the device 10 containing the slot 12 and within a border portion 18 surrounding the insets. The border and insets together define a handle for the device 10.

The triangular insets 14, 16 perform a number of functions. First, they provide an area which may be gripped when using the device 10 and together make up the handle portion of the device referred to above. The triangular insets 14, 16 also provide a field for a label or advertisement, which may be hot stamped or adhesively mounted into the triangular insets 14, 16. Finally, by molding in the triangular insets 14, 16 the amount of plastic used in molding the device 10 is conserved to minimize the cost of construction of the device 10.

In the preferred embodiment the thickness of the device is approximately 0.140 inches, with the thickness of material between the triangular insets 14, 16 being about half the thickness of the rest of the device 10, preferably about 0.065 inches. The thickness of the device 10 is mandated by two considerations, the first being the required physical strength of the device 10 considering the material used.

The second consideration is the angle the device may be held at relative to a tube. It is apparent that with a slot 12 of a given width, the thickness of material which may pass through that slot 12 when the device 10 is at a non-perpendicular angle to the tube is affected by the thickness of the device 10. This will be discussed further in context with the configuration of the slot 12.

The length of the slot 12 is determined by the size of tube the device 10 is to be used with. Generally the slot must be long enough to accept the tube to be stripped by the device 10. For example, with a standard size toothpaste tube, the slot 12 would be approximately 2.4375 inches, which is 1/16 inch longer than the width of the standard size toothpaste tube. The width of the slot 12 in a device 10 for use with the standard toothpaste tube would be approximately 0.040 inches.

The configuration of the slot 12 features rounded or curved edges rather than straight right angle edges since the device 10 may be at an angle other than perpendicular with respect to a tube. The curved edges are lead-in radii and provide bearing surfaces for the tube. For the preferred embodiment example for a standard size toothpaste tube used herein, the curvature of the edges of the slot 12 has a radius of approximately 0.0625 inches, which means that for the thickness of the device 10 of 0.140 inches mentioned above, the flat areas of the slot 12 between the curved edges would be approximately 0.015 inches.

Considering these dimensions for the example of a standard size toothpaste tube, and particularly the configuration of the slot 12 as shown in the cross-sectional view of FIG. 2, it is apparent that the effective width of the slot 12 may be varied by varying the angle between the device 10 and the flattened portion of the tube the device 10 is being used on.

Figure 3:
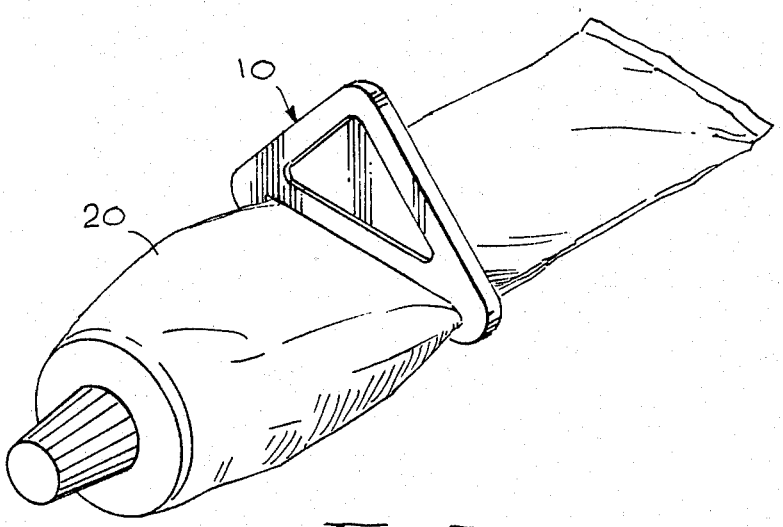
FIG. 3 is a perspective view of the preferred embodiment of the present invention shown in FIGS. 1 and 2 in use on a plastic toothpaste tube to squeeze the toothpaste toward the end of the tube having an opening.

The device 10 is shown in use on a tube 20 in FIG. 3, with the device 10 at an approximately perpendicular angle with respect to the tube 20. It is important to note that the device 10 may be held at a non-perpendicular angle to the plane of the flattened portion of the tube 20 to effectively narrow the slot 12 to increase the effectiveness of the stripping action of the device 10.

The device 10 has been found to be very effective in squeezing a collapsible tube and stripping the substance contained in the tube toward the end having the opening. In practical use, the device 10 will probably not be used until after the tube 20 is partly empty, for example half empty. The device 10 may be left on the tube 20, and will effectively prevent the substance contained in the tube 20 from moving back toward the empty end.

If the end of the tube 20 is too thick to allow the tube 20 to be initially inserted into the slot 12 of the device 10, the end of the tube 20 may be cut off to allow the tube 20 to fit into the slot 12. It may also be convenient to keep cutting off portions of the tube 20 as the device is moved further and further toward the end of the tube 20 with the opening.

The device 10 has been found to be extremely effective in stripping plastic tubes. It is somewhat less effective on metal foil tubes that have a surface that is not relatively smooth. However, since metal foil tubes are now a small minority and plastic tubes are a large majority of tubes used to sell, transport, and store pliable substances, the present invention has broad application.

Figure 4:
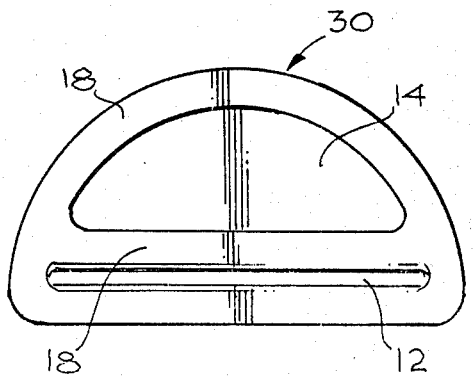
FIG. 4 is a plan view of an alternate embodiment having a semi-circular configuration.
Figure 5:
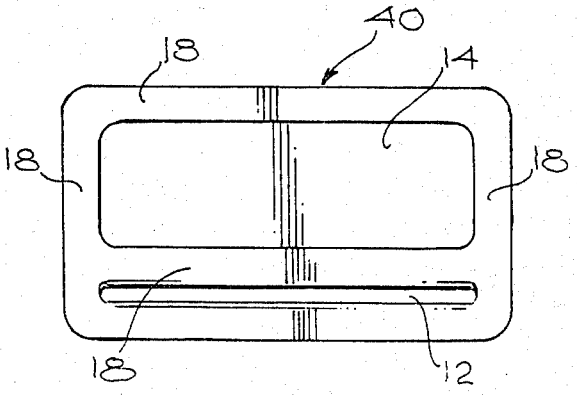
FIG. 5 is a plan view of an alternate embodiment having a rectangular configuration.

It will be recognized that although the example used herein is for a standard size toothpaste tube, the device 10 may be manufactured in various sizes adaptable for use with virtually any collapsible tube containing nearly any pliable substance. Likewise, the configuration may be varied, as shown by the semi-circular configuration device 30 of FIG. 4 and the rectangular configuration device 40 of FIG. 5.

The present invention may be mass produced at a relatively low price, which makes it adaptable for use as a promotional give-away, and due to the compact and thin configuration, the device 10 may be mailed in an envelope. The present invention works extremely well with plastic tubes, and hence finds application in virtually every home for use with a toothpaste tube.

The device 10 is small, and may easily be stored, unlike dispensers. It is also easy to use and inexpensive, and thus represents a vast improvement over dispensers. Unlike tube keys, the present invention works on plastic tubes, and presents excellent performance at a price smaller to or less than the tube key.

Although there have been described above specific arrangements of a collapsible tube squeezing device in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A device for stripping a pliable substance from a flexible, collapsible plastic tube or the like, said tube having an opening at one end thereof from which said pliable substance is extruded, said device comprising:

a molded member characterized by a particular thickness, said member including a stripping portion and a handle portion for gripping said device; and means defining a slot disposed in said stripping portion for squeezing said tube to flatten it and strip said pliable substance from said tube, said slot extending through said member and having a length and width sufficient to accept the end of said tube opposite said opening and to effectively squeeze said tube relatively flat to strip virtually all of said substance from said tube, said slot also being characterized by curved edges to allow said slot width to be effectively narrowed by operating said device at a non-perpendicular angle with respect to the plane of the portion of said tube which is flattened, the handle portion being positioned to extend from only one side of the stripping portion to inherently establish said non-perpendicular angle and narrowed effective slot width as the handle portion and the end of the tube opposite the opening are pulled in opposite directions, thereby increasing the efficiency of the stripping action;

wherein said handle portion comprises a first inset area disposed on one side of said member away from said slot defining means and a second inset area disposed on the other side of said member away from said slot means, said first and second inset areas being in corresponding locations on opposite sides of said member.

2. A device as defined in claim 1 wherein said device is manufactured in a single piece of plastic material by injection molding.

3. A device as defined in claim 2 wherein said plastic material is high impact polystyrene.

4. A device as defined in claim 1 wherein said inset areas are triangular in shape and the thickness of the member between said first and second inset areas is approximately 0.065 inches.

5. A device as defined in claim 1 wherein said device is to be used with a standard size toothpaste tube and said slot width is approximately 0.040 inches.

6. A device as defined in claim 5 wherein said slot length is approximately 2.4375 inches to easily accommodate said standard size toothpaste tube.

7. A device as defined in claim 1 wherein said slot has flat slot surfaces between said curved edges, said flat slot surfaces contacting said tube when said device is at a perpendicular angle with respect to the plane of said portion of said tube which is flattened.

8. A device as claimed in claim 1 wherein said particular thickness of said member is approximately 0.140 inches.

9. A device as defined in claim 8 wherein said curved edges of said slot have radii of approximately 0.0625 inches.

10. The device of claim 1 wherein said member is of a substantially triangular configuration, the slot portion substantially constituting the base of the triangular configuration and the handle portion constituting the major part of the remainder of the triangular configuration extending to the apex of said configuration.

11. The device of claim 1 wherein said member is of a substantially semi-circular configuration, the slot portion substantially constituting the diametral segment of the semi-circular configuration and the handle portion constituting the major part of the remainder of the semi-circular configuration extending to the periphery of said configuration.

12. The device of claim 1 wherein said member is of a substantially rectangular configuration, the slot portion extending adjacent one longer edge of the rectangular configuration and the handle portion constituting the major part of the remainder of the rectangular configuration extending to the opposite edge of said configuration.

13. A device for stripping a pliable substance from a flexible, collapsible plastic tube or the like, said tube having an opening at one end thereof from which said pliable substance is extruded, said device comprising:

a molded member characterized by a particular thickness, said member including a stripping portion and a handle portion for gripping said device; and means defining a slot disposed in said stripping portion for squeezing said tube to flatten it and strip said pliable substance from said tube, said slot extending through said member and having a length and width sufficient to accept the end of said tube opposite said opening and to effectively squeeze said tube relatively flat to strip virtually all of said substance from said tube, said slot also being characterized by curved edges to allow said slot width to be effectively narrowed by operating said device at a non-perpendicular angle with respect to the plane of the portion of said tube which is flattened, the handle portion being positioned to extend from only one side of the stripping portion to inherently establish said non-perpendicular angle and narrowed effective slot width as the handle portion and the end of the tube opposite the opening are pulled in opposite directions, thereby increasing the efficiency of the stripping action;

wherein said member is of a substantially triangular configuration, the slot portion substantially constituting the base of the triangular configuration and the handle portion constituting the major part of the remainder of the triangular configuration extending to the apex of said configuration;

wherein said device is to be used with a standard size toothpaste tube; and wherein said slot width is approximately 0.040 inches.

14. A device as defined in claim 13 wherein said slot length is approximately 2.4375 inches to easily accommodate said standard size toothpaste tube.

15. A device as defined in claim 13 wherein said slot has flat slot surfaces between said curved edges, said flat slot surfaces contacting said tube when said device is at a perpendicular angle with respect to the plane of said portion of said tube which is flattened.

16. A device as defined in claim 13 wherein said particular thickness of said member is approximately 0.140 inches.

17. A device as defined in claim 16 wherein said curved edges of said slot have radii of approximately 0.0625 inches.

18. A device as defined in claim 13 wherein said slot is rectangular and the edges of said slot have lead-in radii to provide bearing surfaces for said tube.

19. A device for stripping toothpaste from a flexible, collapsible plastic toothpaste tube having an opening at one end thereof from which said toothpaste is extruded, said device comprising:

a substantially triangular, generally planar, plastic member having a rectangular slot extending through said member near to and parallel to one edge of said member, said slot having a length sufficiently long to accept said toothpaste tube when said toothpaste tube is flattened, said slot having a width designed to cause said tube to be substantially flattened when said slot is moved along said tube to cause said toothpaste to be stripped from the flattened portion of said toothpaste tube toward the end of said toothpaste tube having said opening disposed therein, said slot having rounded edges to allow said device to be moved to strip said tube while said member is at a non-perpendicular angle with respect to the flattened portion of said toothpaste tube, thereby increasing the efficiency of the stripping action of said device; and means for gripping said device, said gripping means being offset from said one edge on the opposite side of the slot therefrom, said offset gripping means being effective to inherently establish said non-perpendicular angle and narrow the effective width of the slot as the device is pulled along the tube by said offset gripping means, said means including a first inset surface disposed on one side of said member away from said slot, said means also including a second inset surface disposed on the other side of said member away from said slot, said first and second inset surfaces being in corresponding locations on opposite sides of said member.

* * * * *